United States Patent [19]

Huddleston et al.

[11] Patent Number: 4,865,951

[45] Date of Patent: Sep. 12, 1989

[54] BILAYERED ANODIZED ALUMINUM SUPPORT, METHOD FOR THE PREPARATION THEREOF AND LITHOGRAPHIC PRINTING PLATE CONTAINING SAME

[75] Inventors: Thomas J. Huddleston, Greeley; William P. Smith, Windsor; Gary R. Miller, Fort Collins, all of Colo.

[73] Assignee: Eastman Kodak Company, Rochester, N.Y.

[21] Appl. No.: 112,182

[22] Filed: Oct. 22, 1987

[51] Int. Cl.[4] ..... C25D 11/12; B41N 1/08

[52] U.S. Cl. ..... 430/278; 430/302

[58] Field of Search ..... 430/278, 302

[56] References Cited

U.S. PATENT DOCUMENTS 4,647,346 3/1987 Miller et al. ..... 430/278

OTHER PUBLICATIONS

Keller et al., "Structural Features of Oxide Coatings on Aluminum," *J. Electrochem. Soc.,* vol. 100, No. 9, pp. 411–419, Sep. 1953.

*Primary Examiner*—Paul R. Michl
*Assistant Examiner*—Thorl Chea
*Attorney, Agent, or Firm*—William J. Davis

[57] ABSTRACT

An anodized aluminum support for use in a lithographic printing plate comprises a bilayered anodic surface having a total average thickness of at least 0.10 micrometers consisting essentially of oxides and phosphates of aluminum present in a coverage of greater than 100 milligrams per square meter of support. The anodic surface comprises an upper stratum comprising pores having an average diameter of $1.0\times10^{-8}-7.5\times10^{-8}$ m and a lower stratum comprising pores having an average diameter substantially greater than the pores in the upper stratum. The support is prepared by a two-stage process of anodically oxidizing at least one surface of an aluminium plate in an aqueous electrolyte comprising phosphoric acid under conditions wherein the upper stratum is formed in the first stage and the lower stratum is formed in the second stage. A lithographic printing plate comprising a radiation-sensitive layer and the above-described support exhibits improved resistance to staining.

13 Claims, 3 Drawing Sheets

BILAYERED ANODIZED ALUMINUM SUPPORT, METHOD FOR THE PREPARATION THEREOF AND LITHOGRAPHIC PRINTING PLATE CONTAINING SAME

BACKGROUND OF THE INVENTION

1. Field of the Invention

This invention relates to a novel bilayered phosphoric acid anodized aluminum support for use in a lithographic printing plate, to a method for the preparation of such support, and to a lithographic printing plate comprising the support which exhibits improved resistance to staining in non-image areas and good adhesion.

2. Description of the Prior Art

U.S. Pat. No. 4,647,346 describes a superior lithographic printing plate having improved abrasion resistance comprising a phosphoric acid anodized aluminum support surface sufficiently porous to achieve adequate adhesion. This plate has achieved widespread commercial acceptance. However, such plate has demonstrated on occasion, and for reasons that are not completely understood, a tendency to stain in non-image areas. Poor resistance to staining manifests itself during the printing operation as an increase in density in non-image areas. This is believed to result, at least in part, from ink retention in the non-image areas. Such stain can cause press operators to make unnecessary adjustments during press runs and, if severe, can cause ink to be transferred to the non-image areas of the print.

Attempts have been made to increase the resistance to staining of the plate described in the above-noted patent. However, such attempts, prior to this invention, have met with only limited success in that improved stain resistance has been achieved only at the expense of an unacceptable decrease in surface adhesion.

Thus, there is a need for a lithographic printing plate having the advantages of the plate described in U.S. Pat. No. 4,647,346 yet having improved resistance to staining while retaining good adhesion.

SUMMARY OF THE INVENTION

In accordance with the present invention, there is provided a lithographic printing plate having improved resistance to staining, good abrasion resistance and good adhesion.

The invention provides an anodized aluminum support, for use in a lithographic printing plate, comprising a bilayered anodic surface having a total average thickness of at least 0.10 micrometers. The anodic surface consists essentially of oxides and phosphates of aluminum present in a coverage of greater than 100 milligrams per square meter of support and comprises an upper stratum comprising pores having an average diameter of $1.0 \times 10^{-8} - 7.5 \times 10^{-8}$ m and a lower stratum comprising pores having an average diameter substantially greater than the pores in the upper stratum.

The support of this invention is prepared by a process of anodicially oxidizing at least one surface of an aluminum plate in an aqueous electrolyte comprising phosphoric acid including sequentially the stages of (1) contacting the plate with an electrolyte comprising phosphoric acid under conditions which form on the surface an upper stratum comprising pores having an average diameter of $1.0 \times 10^{-8} - 7.5 \times 10^{-8}$ m, (c) contacting the plate with an electrolyte comprising phosphoric acid under conditions which form a lower stratum comprising pores having an average diameter substantially greater than the pores in the upper stratum.

A lithographic printing plate in accordance with the present invention comprises a radiation sensitive layer and the above-described bilayered anodized aluminum support. The lithographic printing plate of this invention exhibits improved resistance to staining, good abrasion resistance and good adhesion.

DETAILED DESCRIPTION OF THE PREFERRED EMBODIMENTS

The support material comprises an aluminum or aluminum alloy plate. Suitable aluminum alloys include alloys with zinc, silicon, chromium, copper, manganese, magnesium, chromium, zinc, lead, bismuth, nickel, iron or titanium which may contain negligible amounts of impurities. Preferred plates have a thickness of about 0.06 to about 0.6 millimeters.

The surface of the aluminum plate is preferably subjected to chemical cleaning such as degreasing with solvents or alkaline agents for the purpose of exposing a clean surface free of grease, rust or dust which is usually present on the aluminum surface. Preferably, the surface is grained. Suitable graining methods include glass bead graining, quartz slurry graining, ball graining, said blasting, brush graining and electrolytic graining. Following the graining operation, the support can be treated with an aluminum etching agent and/or a desmutting acid bath.

A bilayered anodic surface is then formed on at least one surface of the aluminum plate. The bilayered anodic surface is formed in a process comprising two stages. In both stages, an electric current is passed through the plate immersed as an anode in an electrolytic solution containing phosphoric acid as further described hereinafter.

The bilayered anodic surface consists essentially of oxides and phosphates of aluminum and has a total average thickness of at least 0.10 micrometers. In preferred embodiments, the anodic surface has a total average thickness greater than 0.40 micrometers. Total average thicknesses greater than 0.50 micrometers have been found to yield printing plates having particularly good abrasion resistance and thicknesses greater than 1.00 micrometers and higher can be obtained as exemplified below. The oxides and phosphates of aluminum are present in a total coverage of greater than 100 milligrams per square meter of support, and more preferably, are present in a total coverage of greater than 500 milligrams per square meter of support.

Figure 1:
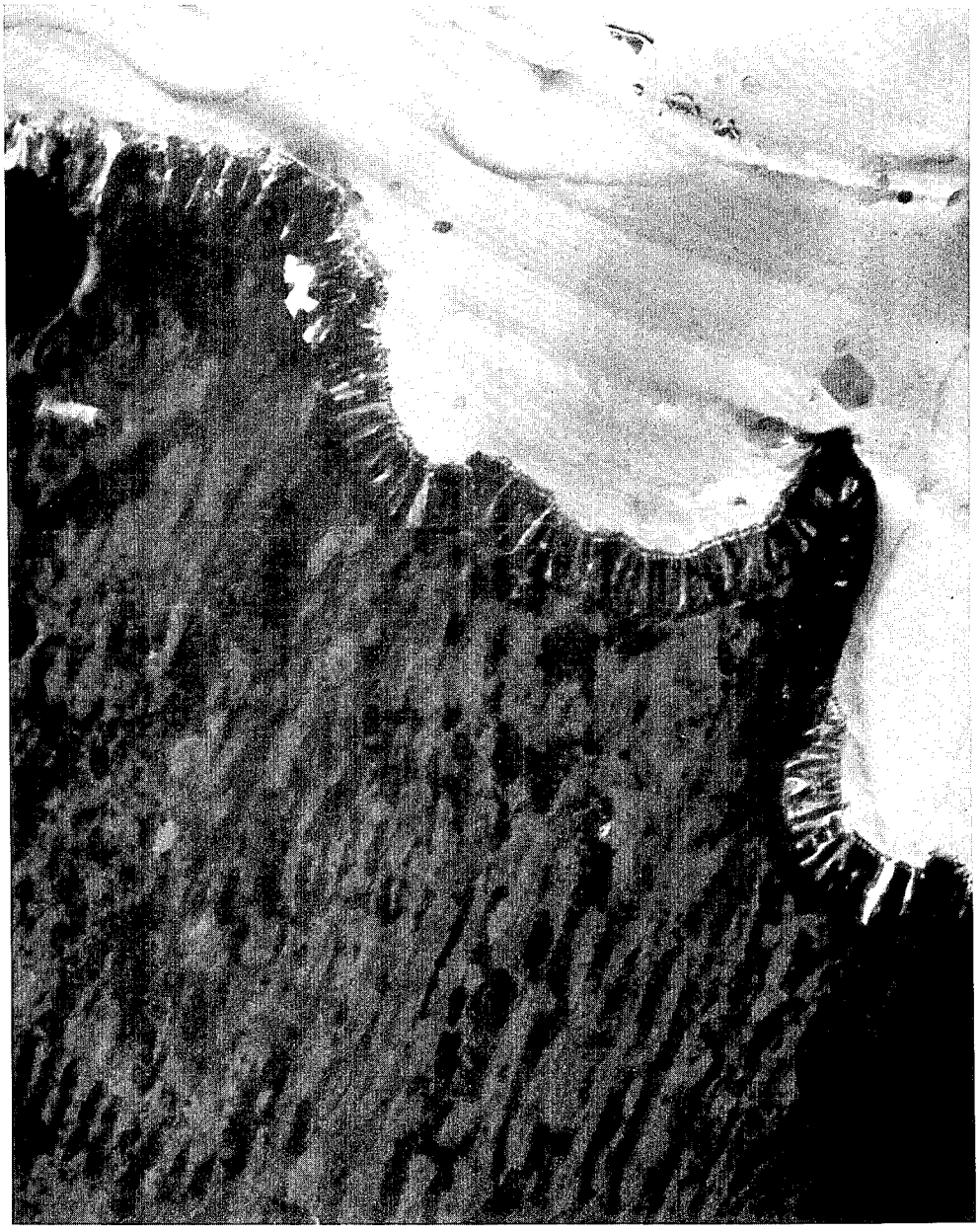
FIG. 1 is a cross-sectional photomicrograph illustrating the bilayered anodic surface of the aluminum support of this invention as viewed through a transmission electron microscope at 30,000x magnification.
Figure 2:
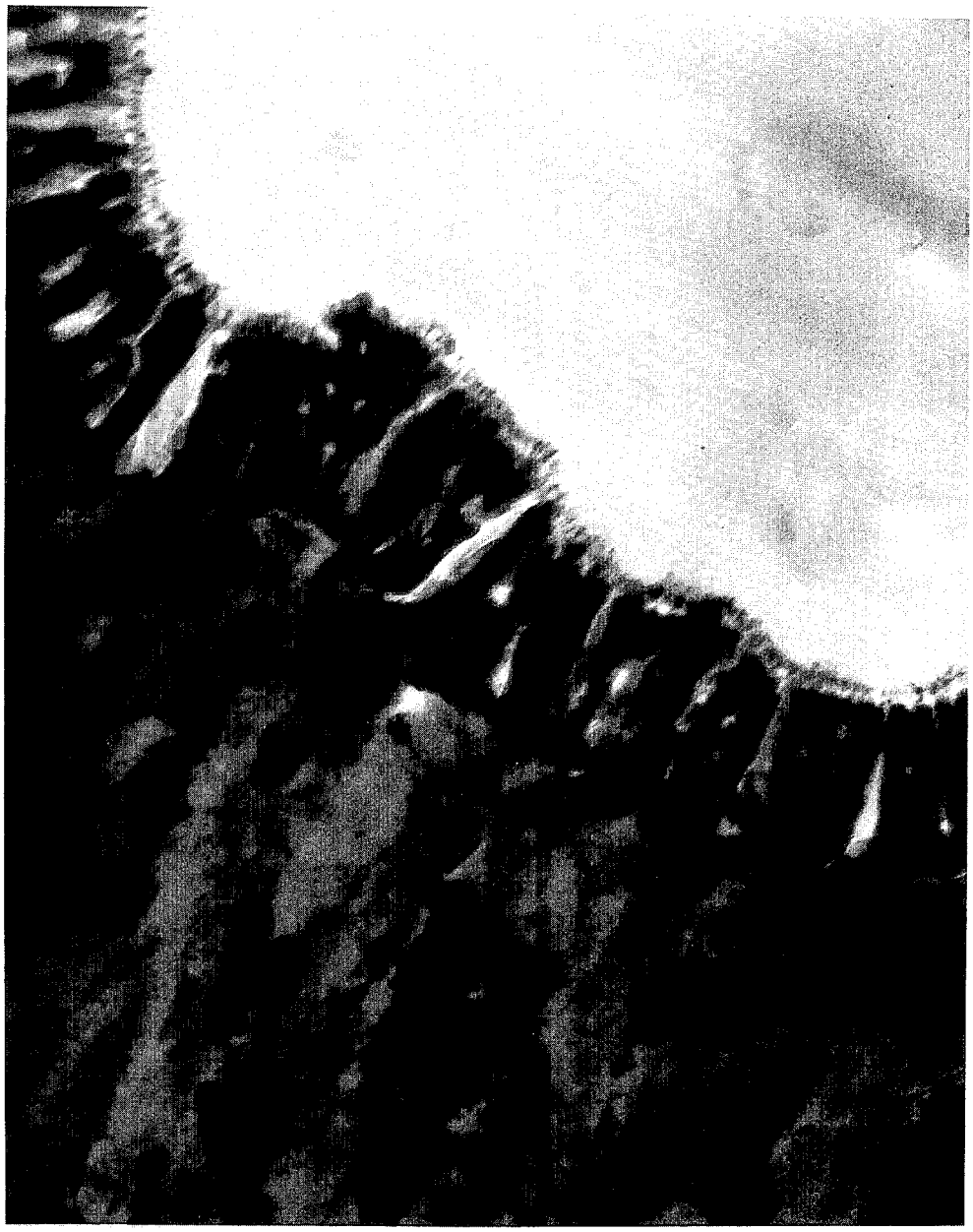
FIG. 2 is a photomicrograph as in FIG. 1 at 84,000x magnification.
Figure 3:
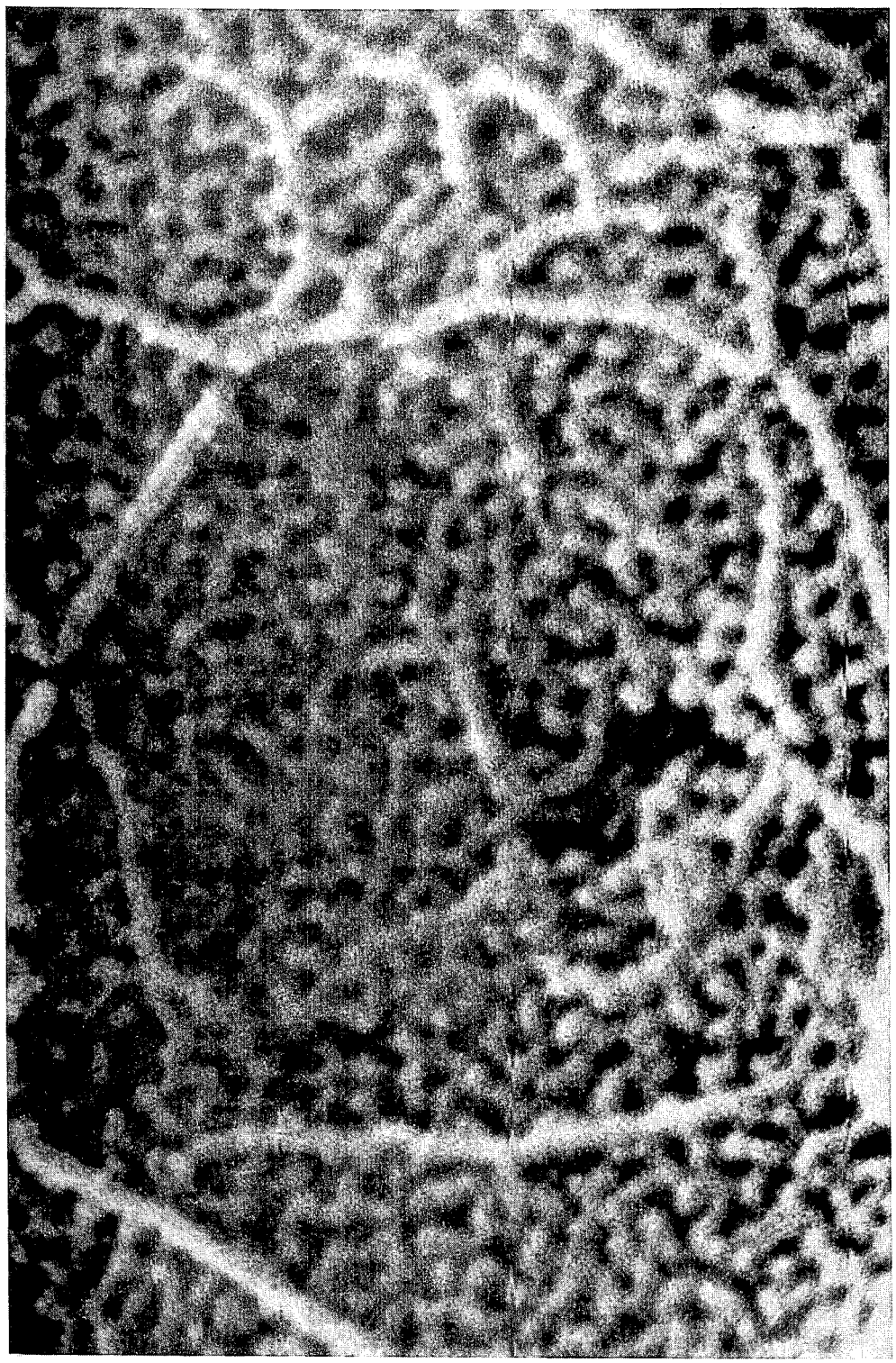
FIG. 3 is a surface photomicrograph illustrating the porous structure of the upper stratum of the anodic surface of the support of this invention as viewed through a scanning electron microscope at 104,000x magnification.

The support of this invention has a bilayered anodic surface comprising upper and lower strata as depicted in FIGS. 1 and 2. The upper stratum comprises pores, as depicted in FIG. 3, having an average diameter of 1.0

$\times 10^{-8} - 7.5 \times 10^{-8}$ m. Pores smaller than $1.0 \times 10^{-8}$ m in average diameter generally do not provide a sufficiently porous surface to achieve adequate adhesion. Pores greater than $7.5 \times 10^{-8}$ m in average diameter are generally not effective in providing lithographic printing plates having improved resistance to staining. The upper stratum preferably comprises pores having an average diameter of $2 \times 10^{-8} - 6 \times 10^{-8}$ m.

The above-described bilayered support of this invention is prepared in a two-stage process of anodically oxidizing at least one surface of an aluminum plate in an aqueous electrolyte comprising phosphoric acid. The upper and lower strata are formed respectively in the first and second anodizing stages.

In the first stage, the plate is contacted with an electrolyte preferably comprising 10 to 40% phosphoric acid by weight, more preferably 15 to 30% phosphoric acid by weight, and at an anodizing condition preferably of at least 0.04 amp. min/dm$^2$. An anodizing condition of at least 0.08 amp. min/dm$^2$ is particularly preferred. A preferred range of anodizing times is from about 5 to about 30 seconds. The electrolyte temperature in the first stage can range from about 20° C. to about 70° C. with an electrolyte temperature in the range of 30° C. to 55° C. being preferred. The anodizing voltage in the first stage can be from about 10 to about 80 volts with 15–70 volts being preferred. The above-described upper stratum is formed in the first stage.

Thereafter, the plate is subjected to further anodic oxidation in a second stage. In the second stage, the plate is contacted with an aqueous electrolyte comprising phosphoric acid preferably at an anodizing condition of at least 2.0 amp. min/dm$^2$. The electrolyte preferably comprises from about 15–45%, more preferably from 15–25% phosphoric acid by weight. The electrolyte temperature during anodization can range from about 20° C. to about 70° C. A range of typical anodizing times is from 15 seconds to 3 minutes. In the second stage, the anodic oxidation preferably is carried out at an anodizing voltage of at least 50 volts. The lower stratum is formed in the second stage. The lower stratum comprises pores having an average diameter substantially greater than the pores in the upper stratum as is depicted in FIG. 3. The greater average pore diameter in the lower stratum results from different anodizing conditions in the second stage.

In a preferred embodiment of this invention, the bilayered anodized surface can be silicated and subsequently contacted with an aqueous solution comprising a metal salt having the formula MX wherein M is a metal selected from the group consisting of Zn, Mg, Ni and Cr and X is an anion selected from the group consisting of acetate, borate and chloride as described in commonly assigned U.S. Pat. application Ser. No. 38,436 filed April 13, 1987, the disclosure of which is hereby incorporated by reference. Such treatment can improve the incubation stability and extend the shelf-life of the lithographic printing plate.

The treated or untreated support can be coated, if desired, with a thin coating of a hydrophilic material. The hydrophilic coating contributes to improving the water receptivity of the non-printing areas of the processed plate. Preferably, the hydrophilic coating is coated over a support treated as described above. The hydrophilic coating is coated by known techniques in a subbing amount. It is particularly advantageous to use a water-soluble permanently hydrophilic material which can be coated from an aqueous dispersion. A solution containing polyacrylamide is especially advantageous for this purpose, as are solutions containing carboxymethyl cellulose, polyvinylphosphonic acid, sodium silicate and combinations of these. Other polymers useful in forming hydrophilic interlayers include polyvinylalcohol, copolymers of maleic anhydride with ethylene vinyl acetate, styrene or vinyl methyl ether, polyacrylic acid, hydroxymethyl cellulose and polyvinyl pyrrolidone. A particularly useful hydrophilic subbing composition is described in U.S. Pat. No. 3,860,426. In a preferred embodiment of this invention, the treated or untreated support is coated with a hydrophilic subbing composition in accordance with the teaching of U.S. Pat. No. 4,640,886. In this embodiment, the hydrophilic subbing layer can comprise carboxymethylcellulose, benzoic acid, and optionally sodium molybdate and/or a surfactant.

The lithographic printing plate of this invention comprises a radiation sensitive layer and the above-described support. A radition sensitive coating is placed directly on the treated or untreated support or preferably, over one or more subbing layers. Supports prepared in accordance with the teaching of this invention achieve good adhesion while improving the resistance of the printing plate to non-image stain.

Various radiation sensitive materials suitable for forming images for use in the lithographic printing process can be used. Almost any radiation sensitive layer is suitable which after exposure, if necessary followed by developing and/or fixing, provides an area in imagewise distribution which may be used for printing.

Radiation sensitive materials useful in this invention are well known in the art, and include silver halide emulsions, as described in Research Disclosure, publication 17643, paragraph XXV, Dec., 1978 and references noted therein; quinone diazides (polymeric and non-polymeric), as described in U.S. Pat. No. 4,141,733 (issued Feb. 27, 1979 to Guild) and references noted therein; light sensitive polycarbonates, as described in U.S. Pat. No. 3,511,611 (issued May 12, 1970 to Rauner et al) and references noted therein; diazonium salts, diazo resins, cinnamal-malonic acids and functional equivalents thereof and others described in U.S. Pat. No. 3,342,601 (issued Sept. 19, 1967 to Houle et al) and reference noted therein; and light sensitive polyesters, polycarbonates and polysulfonates, as described in U.S. Pat. No. 4,139,390 (issued Feb. 13, 1979 to Rauner et al) and references noted therein.

Particularly useful radiation sensitive materials are photocrosslinkable polymers, such as polyesters, containing the photosensitive group

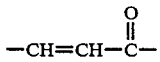

as an integral part of the polymer backbone. For example, preferred photocrosslinkable polymers are polyesters prepared from one or more compounds represented by the following formulae:

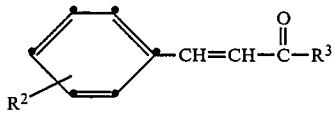

(A)

wherein $R^2$ is one or more alkyl of 1 to 6 carbon atoms, aryl of 6 to 12 carbon atoms, aralkyl of 7 to 20 carbon atoms, alkoxy of 1 to 6 carbon atoms, nitro, amino, acrylic, carboxyl, hydrogen or halo and is chosen to provide at least one condensation site; and $R^3$ is hydroxy, alkoxy of 1 to 6 carbon atoms, halo or oxy if the compound is an acid anhydride. A preferred compound is p-phenylene diacrylic acid or a functional equivalent thereof. These and other useful compounds are described in U.S. Pat. No. 3,030,208 (issued April 17, 1962 to Schellenberg et al), U.S. Pat. No. 3,702,765 (issued Nov. 14, 1972 to Laakso), U.S. Pat. No. 3,622,320 (issued Nov. 23, 1971 to Allen) and U.S. Pat. No. 3,929,489 (issued Dec. 30, 1975 to Arcesi et al), the disclosures of which are incorporated herein by reference.

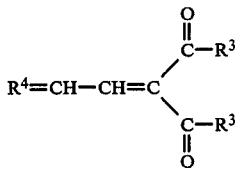

(B)

$R^3$ is as defined above, and $R^4$ is alkylidene of 1 to 4 carbon atoms, aralkylidene of 7 to 16 carbon atoms, or a 5- to 6-membered heterocyclic ring. Particularly useful compounds of formula (B) are cinnamylidenemalonic acid, 2-butenylidene malonic acid, 3-pentenylidenemalonic acid, o-nitrocinnamylidenemalonic acid, naphthylallylidenemalonic acid, 2-furfurylidenethylidenemalonic acid and functional equivalents thereof These and other useful compounds are described in U.S. Pat. No. 3,674,745 (issued July 4, 1972 to Philipot et al), the disclosure of which is incorporated herein by reference.

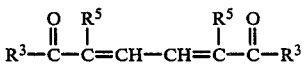

(C)

$R^3$ is as defined above; and $R^5$ is hydrogen or methyl. Particularly useful compounds of formula (C) are trans, trans-muconic acid, cis, transmuconic acid, cis, cismuconic acid, $\alpha,\alpha'$-cis, trans-dimethylmuconic acid, $\alpha,\alpha'$-cis, cis-dimethylmuconic acid and functional equivalents thereof. These and other useful compounds are described in U.S. Pat. No. 3,615,434 (issued Oct. 26, 1971 to McConkey), the disclosure of which is incorporated herein by reference.

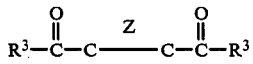

(D)

$R^3$ is as defined above; and Z represents the atoms necessary to form an unsaturated, bridged or unbridged carbocyclic nucleus of 6 or 7 carbon atoms. Such nucleus can be substituted or unsubstituted. Particularly useful compounds of formula (D) are 4-cyclohexene-1,2-dicarboxylic acid, 5-norbornene-2,3-dicarboxylic acid, hexachloro-5[2:2:1]-bicycloheptene-2,3-dicarboxylic acid and functional equivalents thereof. These and other useful compounds are described in Canadian Pat. No. 824,096 (issued Sept. 30, 1969 to Mench et al), the disclosure of which is incorporated by reference.

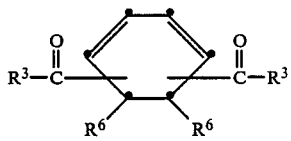

(E)

$R^3$ is as defined above; and $R^6$ is hydrogen, alkyl of 1 to 12 carbon atoms, cycloalkyl of 5 to 12 carbon atoms or aryl of 6 to 12 carbon atoms. $R^6$ can be substituted, where possible, with such substituents as do not interfere with the condensation reaction, such as halo, nitro, aryl, alkoxy, aryloxy, etc. The carbonyl groups are attached to the cyclohexadiene nucleus meta or para to each other, and preferably para. Particularly useful compounds of formula (E) are 1,3-cyclohexadiene-1,4-dicarboxylic acid, 1,3-cyclohexadiene-1,3-dicarboxylic acid, 1,5-cyclohexadiene-1,4-dicarboxylic acid and functional equivalents thereof. These and other useful compounds are described in Belgian Pat. No. 754,892 (issued October 15, 1970), the disclosure of which is incorporated herein by reference.

In a particularly preferred embodiment, the lithographic printing plate of this invention comprises the high speed aqueous developable radiation sensitive composition described in commonly assigned U.S. Pat. application Ser. No. 10,521 filed February 3, 1987 in the name of M. S. Kaplan, the disclosure of which is hereby incorporated by reference.

The radiation-sensitive coating can be prepared by dispersing the radiation sensitive composition or polymer in any suitable solvent or combination of solvents used in the art.

Radiation-sensitivity can be stimulated in the coating composition by incorporating a sensitizer. Suitable sensitizers include anthrones, such as 1-carbethoxy-2-keto-3-methyl-2-azabenzanthrone, benzanthrone; nitro sensitizers; triphenylmethanes; quinones; cyanine dye sensitizers; naphthone sensitizers such as 6-methoxybeta-2-furyl-2-acrylonaphthone; pyrylium or thiapyrylium salts, such as 2,6-bis(p-ethoxyphenyl)-4-(p-n-amyloxyphenyl)-thiapyrylium perchlorate and 1,3,5-triphenylpyrylium fluoroborate; furanone; 4-picoline-N-oxide; anthraquinones such as 2-chloroanthraquinone; thiazoles such as 2-benzoylcarbethoxymethylene-1-methylbetanaphthothiazole and methyl 2-(n-methylbenzothiazolylidene)dithioacetate; methyl 3-methyl-2-benzothiazolidene dithioacetate; thiazolines such as 3-ethyl-2-benzoylmethylenenaphtho[1,2-d]-thiazoline, benzothiazoline, (2-benzoylmethylene)-1-methyl-beta-naphthothiazoline; 1,2-dihydro-1-ethyl-2-phenacylidenenaphtho[1,2-d]-thiazole; and naphthothiazoline; quinolizones, Michler's ketone; and Michler's thioketone. Particularly preferred sensitizers are the coumarins described in U.S. Pat. No. 4,147,552.

In addition to the sensitizers, a number of other addenda can be present in the coating composition and ultimately form a part of the lithographic plate. For example, dyes or pigments may be included to obtain colored images to aid in recognition. Other components which can be advantageously included in the coating composition are materials which serve to improve film formation, coating properties, adhesion of the coatings to the support, mechanical strength and stability.

The lithographic printing plate of the present invention can be exposed by conventional methods, for example through a transparency or a stencil, to an imagewise pattern of actinic radiation. Suitable radiation sources include sources rich in visible radiation and sources rich in utlraviolet radiation. Carbon arc lamps, mercury vapor lamps, fluorescent lamps, tungsten filament lamps, photoflood lamps, lasers and the like are useful herein. The exposure can be by contact printing techniques, by lens projection, by reflex, by bireflex, from an image-bearing original or by any other known technique.

The exposed lithographic printing plate can be developed using conventional developer and developing techniques. For example, in developing the lithographic printing plates incorporating radiation-sensitive polyesters noted above, the developer composition is applied to the surface of the plate for a period of time sufficient to remove the polymer from non-image areas of the plate. Gentle mechanical action aids in removing the polymer composition from these areas. Thus, swabbing is a useful method of applying the developer composition to the plate. The developer composition is typically used at room temperature but it can be employed at elevated temperatures up to about 32° C. The developer can be an aqueous alkaline solution having a pH in the range of 9 to 14 optionally including an alcohol. After the initial application of the developer composition, a second application can be applied, followed by either a single or double application of a desensitizing composition. The plate is then dried by conventional techniques.

The following Examples further illustrate the practice of this invention.

EXAMPLES 1-19

An aluminum plate having a thickness of about 0.3 millimeter was immersed in a caustic solution to remove oil and dirt from the surface. The surface was grained with a brush and an abrasive quartz slurry. Loose residue was removed by immersion in a caustic solution followed by an acid desmutting bath.

The aluminum plate was then anodized in a two-stage process under the conditions listed in the table below. In both stages, the phosphoric acid concentration was about 22% by weight and the electrolyte temperature ranged from about 30° C. to about 55° C.

The anodized plate was treated in a 3% solution of sodium silicate. The $SiO_2$ to $Na_2O$ ratio was about 2:1. The anodized and silicated plate was then immersed in an aqueous bath comprising zinc acetate.

The treated support material was coated with a hydrophilic subbing layer containing benzoic acid as described in U.S. Pat. No. 4,640,886.

The plate was then coated with a radiation-sensitive coating as described in U.S. Pat. No. 3,030,208, a condensation product of hydroxyethyoxycyclohexane and p-phenylenediethoxy arcylate.

The plate was suitably exposed and developed using the developer described in Examples 1-8 of U.S. Pat. No. 4,419,437. The development was complete.

The physical properties of the lithographic printing plate are set forth in the Table. Examples 1-19 exhibited a bilayered anodic structure as described hereinabove and acceptable strain and adhesion properties. In each of Examples 1-19, the lower stratum comprised pores having an average diameter substantially greater than the pores in the upper stratum.

The strain reported is the density in non-image areas after a press run minus the density in non-image areas before the press run as measured by a densitometer. Increases of stain greater than +0.13 are generally unacceptable in the trade. A negative stain difference (decrease in stain density) is believed to result from the effect of fountain solutions, etc. during the press run and is acceptable.

Comparative Example A was prepared under conditions which formed a nonporous upper stratum. The phosphoric acid concentration was 12% and the electrolyte temperature was 19° C. in the first stage. The support material of Comparative Example A exhibited unacceptable adhesion. Adhesion was determined as follows. The plate is exposed through a 0.15 log E step tablet and developed under normal conditions. The plate is then hand rubbed for about 15 seconds. The reported adhesion is the number of steps removed by rubbing. The greater number of steps removed corresponds to poorer adhesion. Although in actual practice plate performance varies widely depending on press conditions, we have found a good correlation between adhesion measured by our above-described test and number of acceptable impressions to failure.

| Ex. | Stage 1 Anodizing Condition (amp. min/dm$^2$) | Stage 2 Anodizing Condition (amp. min/dm$^2$) | Total Thickness of Anodized Stratum (micrometers) | Face Side Oxide Mass (mg/m$^2$) | Average Pore Dia. in Upper Stratum ($\times 10^{-8}$m) | Stain (density) | Adhesion (steps) |
|---|---|---|---|---|---|---|---|
| 1 | 0.52 | 2.07 | 0.57 | 620 | 2.5 | .02 | 2 |
| 2 | 0.32 | 2.26 | 0.52 | 660 | 1.9 | −.01 | 2 |
| 3 | 0.51 | 2.05 | 0.53 | 600 | 2.7 | .01 | 2 |
| 4 | 0.51 | 2.05 | 0.58 | 680 | 2.8 | .01 | 3 |
| 5 | 0.51 | 2.06 | 0.64 | 740 | 3.1 | .01 | 4 |
| 6 | 0.09 | 2.26 | 0.49 | 720 | 4.0 | .04 | 3 |
| 7 | 0.56 | 2.27 | 0.58 | 860 | 5.5 | .12 | 2 |
| 8 | 0.16 | 2.26 | 0.44 | 650 | 2.4 | .04 | 2 |
| 9 | 0.49 | 2.26 | 0.51 | 680 | 2.6 | .04 | 2 |
| 10 | 0.32 | 2.26 | 0.51 | 630 | 2.3 | .03 | 3 |
| 11 | 0.66 | 3.66 | 0.81 | 1050 | 4.1 | .11 | 1 |
| 12 | 0.32 | 2.27 | 0.50 | 540 | 3.0 | .01 | 2 |
| 13 | 0.32 | 2.26 | 0.48 | 670 | 3.5 | −.02 | 2 |
| 14 | 0.61 | 4.30 | 1.04 | 1160 | 3.0 | .13 | 2 |
| 15 | 0.32 | 2.27 | 0.60 | 740 | 4.7 | .01 | 2 |
| 16 | 0.32 | 2.04 | 0.47 | 740 | 4.8 | −.01 | 2 |
| 17 | 0.32 | 2.28 | 0.51 | 760 | 1.8 | −.03 | 2 |
| 18 | 0.32 | 2.28 | 0.50 | 850 | 1.7 | −.03 | 2 |
| 19 | 0.32 | 2.04 | 0.52 | 647 | 1.2 | −.03 | 3 |
| A | 0.26 | 1.50 | 0.34 | 480 | — | .00 | 9 |

Other support materials prepared in accordance with the method described in U.S. Pat. No. 4,647,346 did not form the above-described bilayered anodic surface.

Although the invention has been described in considerable detail with particular reference to certain perferred embodiments thereof, variations and modifications can be effected within the spirit and scope of the invention.

What is claimed is:

1. An anodized aluminum support for use in a lithographic printing plate, said support comprising a bilayered anodic surface having a total average thickness of at least 0.10 micrometers consisting essentially of oxides and phosphates of aluminum present in a coverage of greater than 100 milligrams per square meter of support, said anodic surface comprising an upper stratum comprising pores having an average diameter of $1.0 \times 10^{-8} - 7.5 \times 10^{-8}$ m and a lower stratum comprising pores having an average diamter substantially greater than the pores in said upper stratum.

2. The support of claim 1 wherein said anodic surface has a total average thickness of at least 0.40 micrometers.

3. The support of claim 1 wherein said upper stratum comprises pores having an average diameter of $2 \times 10^{-8} - 6 \times 10^{-8}$ m.

4. The support of claim 1 wherein said oxides and phosphates of aluminum are present in a coverage of greater than 500 milligrams per square meter of support.

5. A process of anodically oxidizing at least one surface of an aluminum plate in an aqueous electrolyte comprising phosphoric acid, said process comprising the stages of (1) contacting said plate with an electrolyte comprising phosphoric acid under conditions which form on said surface an upper stratum comprising pores having an average diameter of $1.0 \times 10^{-8} - 7.5 \times 10^{-8}$ m, and thereafter (2) contacting said plate with an electrolyte comprising phosphoric acid under conditions which form a lower stratum comprising pores having an average diameter substantially greater than the pores in said upper stratum, whereby said anodic oxidation creates on the surface of said plate a bilayered anodic surface having a total average thickness of at least 0.10 micrometers consisting essentially of oxides and phosphates of aluminum present in a coverage of greater than 100 milligrams per square meter of support.

6. The process of claim 5 wherein said first stage comprises contacting said plate with an electrolyte comprising 10 to 40% phosphoric acid by weight at an electrolyte temperature of from about 20 to about 70° C. and at an anodizing condition of at least 0.04 amp. min/dm$^2$ and said second stage comprises contacting said plate with an electrolyte comprising 15 to 45% phosphoric acid by weight at an electrolyte temperature of from about 20° C. to about 70° C. and at an anodizing condition of at least 2.0 amp. min/dm$^2$.

7. The process of claim 5 wherein said anodizing condition in the first stage is from about 0.08 to 1.0 amp. min/dm$^2$.

8. The process of claim 5 wherein said electrolyte temperature in the first stage is from about 30° C. to about 55° C.

9. The process of claim 5 wherein said second stage is carried out at an anodizing voltage of at least about 50 volts.

10. A lithographic printing plate comprising a radiation-sensitive layer and an anodized aluminum support comprising a a bilayered anodic surface having a total average thickness of at least 0.10 micrometers consisting essentially of oxides and phosphates of aluminum present in a coverage of greater than 100 milligrams per square meter of support, said anodic surface comprising an upper stratum comprising pores having an average diameter of $1.0 \times 10^{-8} - 7.5 \times 10^{-8}$ m and a lower stratum comprising pores having an average diameter substantially greater than the pores in said upper stratum.

11. The plate of claim 10 having a silicate layer in contact with the anodic surface.

12. The plate of claim 10 comprising a hydrophilic layer between said support and said radiation-sensitive layer.

13. The plate of claim 12 wherein said hydrophilic layer comprises benzoic acid.

* * * * *